US009707607B2

(12) United States Patent
Calahan et al.

(10) Patent No.: US 9,707,607 B2
(45) Date of Patent: Jul. 18, 2017

(54) IMPACT EXTRUSION CAN MAKING SYSTEM

(71) Applicant: Integrated Packaging Solutions, LLC, Wheatridge, CO (US)

(72) Inventors: Michael W. Calahan, Wheatridge, CO (US); Kevin M. Gillest, Wheatridge, CO (US)

(73) Assignee: Integrated Packaging Solutions, LLC, Wheatridge, CO (US)

( * ) Notice: Subject to any disclaimer, the term of this patent is extended or adjusted under 35 U.S.C. 154(b) by 484 days.

(21) Appl. No.: 14/522,730

(22) Filed: Oct. 24, 2014

(65) Prior Publication Data

US 2015/0128673 A1 May 14, 2015

Related U.S. Application Data

(60) Provisional application No. 61/902,027, filed on Nov. 8, 2013.

(51) Int. Cl.

| | |
|---|---|
| ***B21D 51/26*** | (2006.01) |
| ***B21C 51/00*** | (2006.01) |
| ***B21C 29/04*** | (2006.01) |
| ***B21C 23/21*** | (2006.01) |
| ***B21D 26/049*** | (2011.01) |
| ***B21C 23/18*** | (2006.01) |

(52) U.S. Cl.

CPC ..... *B21C 51/00* (2013.01); *B21C 23/186* (2013.01); *B21C 23/215* (2013.01); *B21C 29/04* (2013.01); *B21D 26/049* (2013.01); *B21D 51/26* (2013.01)

(58) Field of Classification Search

CPC ..... B21D 26/049; B21D 51/26; B21D 51/00; B21D 23/186; B21D 23/215; B21D 29/04; B21C 51/00

USPC ..... 72/16.9

See application file for complete search history.

(56) References Cited

U.S. PATENT DOCUMENTS

| | | | | |
|---|---|---|---|---|
| 3,723,109 | A * | 3/1973 | Lacock | B22F 3/20 419/48 |
| 6,463,776 | B1 * | 10/2002 | Enoki | B21D 51/26 72/379.4 |
| 8,074,483 | B2 * | 12/2011 | Kojima | B21D 51/26 72/348 |
| 8,727,155 | B2 * | 5/2014 | Oshima | B21D 51/26 220/4.01 |
| 2015/0128673 | A1 * | 5/2015 | Calahan | B21C 51/00 72/16.9 |
| 2015/0273560 | A1 * | 10/2015 | Pilon | B21D 26/049 72/61 |

* cited by examiner

*Primary Examiner* — David B Jones

(74) *Attorney, Agent, or Firm* — William W. Cochran; Cochran Freund & Young LLC

(57) ABSTRACT

Disclosed is an impact extrusion can making system that uses induction heating to preheat an extruder punch and an extruder forming die, to increase yield during a cold start. In addition, a highly precise laser measuring device is used to measure dome thickness, so that stroke length and/or position of an extruder and/or extrusion die can be automatically adjusted in a predictive control system. High quality products with high yield are produced using these techniques.

26 Claims, 6 Drawing Sheets

IMPACT EXTRUSION CAN MAKING SYSTEM

CROSS-REFERENCE TO RELATED APPLICATION

The present application claims the benefit of U.S. Provisional Application Ser. No. 61/902,027, filed Nov. 8, 2013, by Michael W. Calahan and Kevin M. Gillest, entitled "Impact Extrusion Can Making System," the disclosure of which is hereby incorporated herein by reference for all that it discloses and teaches.

BACKGROUND

Cans are widely used throughout the world, including but not limited to, cans that contain beverages and other perishable items. Two piece aluminum cans have revolutionized the can making industry and have assisted beverage companies, and other companies that dispense products in cans at low cost and convenience to consumers.

SUMMARY

An embodiment of the invention may comprise a method of making a can using an impact extrusion process comprising: positioning a slug in a substantially centered position over an opening in an extruder forming die; heating an extruder punch with a punch induction coil using induction heating until the extruder punch reaches first predetermined temperature; heating the extruder forming die with a die induction coil using induction heating until the extruder forming die reaches a second predetermined temperature; forcing the slug into the extruder forming die with the extruder punch with sufficient speed and force to extrude the slug into a can after the extruder punch is heated to the first predetermined temperature and after the extruder forming die is heated to the second predetermined temperature; measuring a thickness of a dome of the can to create a dome thickness signal; discarding the can if the thickness of the dome is not within a range of thicknesses; adjusting a clearance between the extruder punch and the extruder forming die in response to the dome thickness signal.

An embodiment of the invention may further comprise an impact extrusion apparatus for making a can from a slug comprising: an extruder forming die having an opening; an extruder punch that has a size and shape that fits in the opening; a die induction coil disposed to heat the extruder forming die to a first predetermined temperature using induction heating created by die induction current in the die induction coil; a punch induction coil disposed to heat the extruder punch to a second predetermined temperature using induction heating created by punch induction current flowing in the punch induction coil; a punch actuator that drives the extruder punch with sufficient speed and force into the slug and the extruder forming die to extrude the slug into a can after the extruder forming die has been heated to the first predetermined temperature by the die induction coil, and the extruder die has been heated to the second predetermined temperature by the punch induction coil to form the can; a laser measuring device that measures a thickness of a dome of the can to create a dome thickness signal; a controller that generates a clearance adjustment control signal in response to the dome thickness signal; an adjuster that adjusts a clearance space between the extruder forming die and the extruder punch in response to the clearance adjustment control signal to alter the thickness of the dome.

DETAILED DESCRIPTION OF THE EMBODIMENTS

Figure 1:
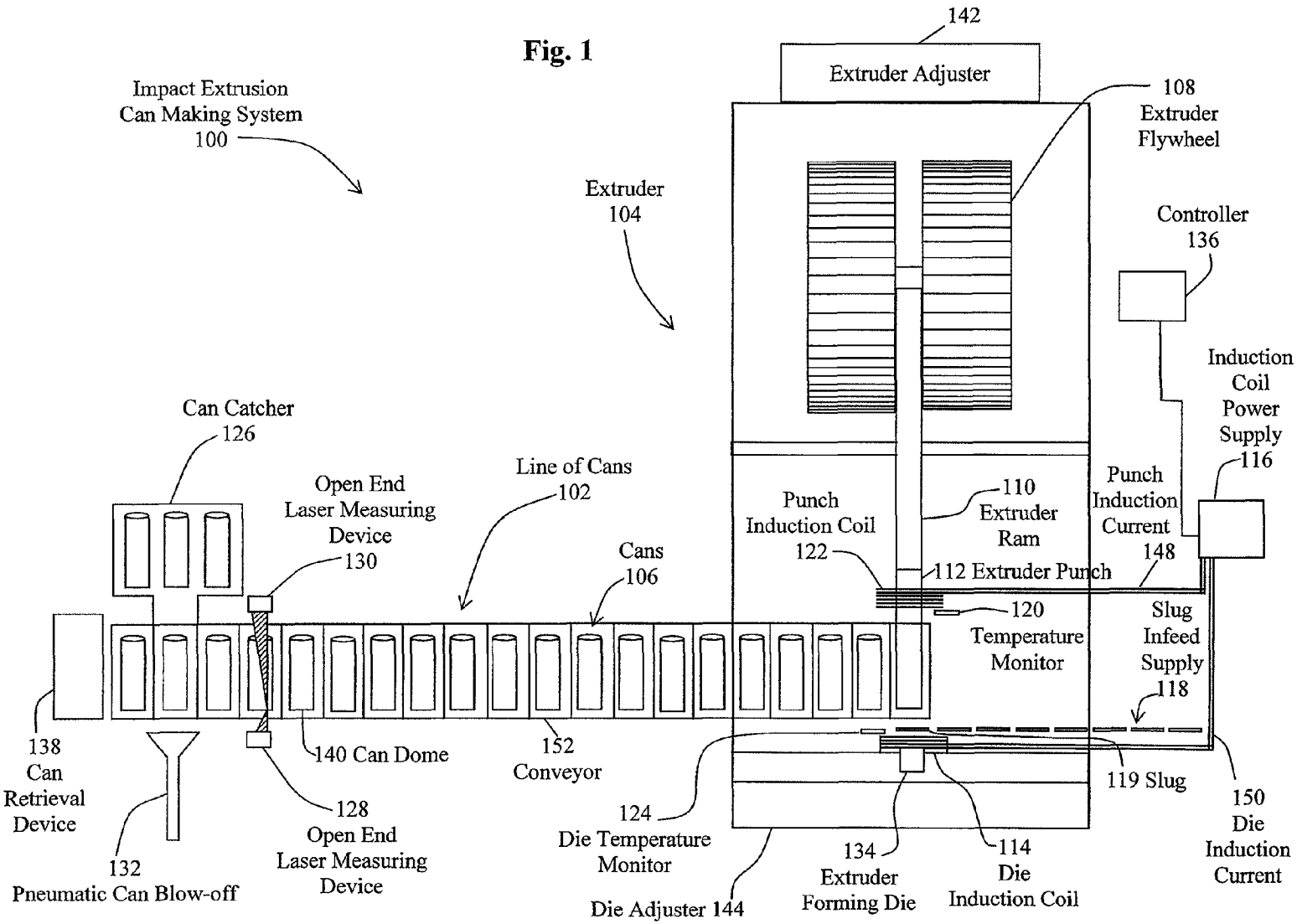
FIG. 1 is a top view of an embodiment of a can making system.

FIG. 1 is a top view of an embodiment of an impact extrusion can making system 100. FIG. 1 illustrates an impact extrusion manufacturing process for making cans. Of course, other products can be made, such as metal toothpaste tube nozzles, $CO_2$ cartridges, aluminum baseball bats and softball bats, battery casings, etc. The concepts and techniques disclosed herein can also be used to produce those products. The impact extrusion process utilizes a slug that is pressed at high velocity with extreme force into a die or mold by a punch. The punch may be attached to a mechanical ram, hydraulic press, or other type of rams. Extruders normally reciprocate at twenty to sixty cycles per minute. In accordance with the process, a cold slug is aligned with the punch and die. The punch makes contact with the slug forcing it around the circumference of the punch and into the die. The metal slug deforms to fit the outside surface of the punch and the inside surface of an opening in the die. Lubricants may be added to aid in the impact extrusion process. Impact extrusion utilizes only a single impact to create the finished shape from the slug. After the slug has been contoured on the outer surface of the punch, an ejector removes the work piece from the punch.

As shown in FIG. 1, the impact extrusion can making system 100 includes extruder 104 that comprises an extruder flywheel 108, an extruder ram 110, an extruder punch 112, and an extruder forming die 134. Slug in-feed supply 118 supplies slugs 119 to extruder forming die 134, so that extruder punch 112 forms a can 106 when the extruder punch 112 punches slug 119 in extruder forming die 134. Induction coil power supply 116 supplies power to punch induction coil 122 and die induction coil 114. Punch induction coil 122 and die induction coil 114 generate an electromagnetic wave that heats up extruder punch 112, extruder forming die 134 and slug 119. Die temperature monitor 124 and temperature monitor 120 detect the temperature of the extruder forming die 134 and extruder punch 112, respectively. The punch induction coil 122 induces a current in the extruder punch 112, which causes the extruder punch 112 to heat up when current passes through the punch induction coil 122 from the punch induction coil power supply 116. Similarly, induction coil power supply 116 generates a current in die induction coil 114, which causes the extruder forming die 134 to heat up in response to current that is induced in the extruder forming die 134.

During operation of the impact extrusion can making system 100, the friction created when the extruder punch 112 forms a can 106 from a slug 119, causes the extruder punch 112 and the extruder forming die 134 to increase in temperature. Typically, the temperature of the extruder forming die 134 and the extruder punch 112 is approximately 250° during continuous and stable operation. Continuous and stable operation of the impact extrusion can making system 100 means that the cans 106 in the line of cans 102 are being properly formed and that the extruder forming die 134 and the extruder punch 112 have reached an operating temperature at which the cans 106 are being formed without the need for heat being added to either the extruder forming die 134 or the extruder punch 112. In addition, the clearance between the extruder punch 112 and extruder forming die 134, during continuous and stable operation, does not need to be frequently adjusted to produce high quality cans 106. When these tools are heated due to the friction created by punching the slugs 119, the cans 106 are properly formed and have a proper height and dome thickness. However, until the extruder punch 112, the extruder forming die 134, and slug 119 reach an operating temperature of about 250°, cans 106 may be improperly formed. For example, dome thicknesses in the cans may be too large and the cans may not have a sufficient height. In order to increase the temperature of the extruder punch 112 and the extruder forming die 134 in prior devices, slugs 119 were run through the can making system 100 until the system reached a suitable operating temperature so that cans were being properly formed. However, this process leads to a significant amount of waste of slugs and improperly formed cans. The punch induction coil 122 can therefore be used to preheat the extruder punch 112. Similarly, the die induction coil 114 can be used to preheat the extruder forming die 134 during start-up of the can making system 100 and slug 119. Die temperature monitor 124 is connected to the controller 136 so that the temperature of the extruder forming die 134 can be monitored by the controller 136. Similarly, punch temperature monitor 120 is connected to the controller 136, which monitors the temperature of the extruder punch 112. The controller 136 is also connected to the induction coil power supply 116 and can separately turn the punch induction coil 122 and die induction coil 114 on and off, so that a temperature of approximately 250° is maintained in the extruder punch 112 and the extruder forming die 134, respectively. By preheating the extruder punch 112 and extruder forming die 134, temperatures that are approximately the same as the operating temperatures during continuous extended operation of the can making system 100. As such, waste can be minimized, especially during start-up of the can making system 100.

During the start-up process, when the operating temperatures of the extruder punch 112 and extruder forming die 134 are not at full operating temperature, the operators of the impact extrusion can making system 100 manually adjust the stroke length of the extruder punch 112 and/or the position of the extruder forming die 134, so that the dome thickness of the can domes 140 are within a desired range of thicknesses. When the domes are within the desire range of thicknesses, cans 206 are made that have the proper length. This process of adjusting the extruder stroke length and/or position of the external forming die may take up to 20 minutes for an experienced extruder operator, until the process is stabilized. For example, an extruder operator may use hand gauges to measure the dome and adjust the stroke length to achieve proper dome thickness. Of course, constant adjustment has to be performed, since both the extruder forming die 134 and the extruder punch 112 expand as the temperature of these devices increases. As such, a large amount of human error is possible and the quality and yield of cans is poor, especially until the entire process is stabilized, which may take twenty minutes, as set forth above, and thousands of wasted cans. As such, an automated method of preheating and performing automated adjustments increases yield and the quality of the cans 106 that are produced in can making system 100.

As further illustrated in FIG. 1, the line of cans 102 is produced at the output of the extruder 104. These cans travel down a conveyor 152 to laser measuring devices 128, 130, which comprise a dome end laser measuring device 128 and an open end laser measuring device 130. The laser measuring devices 128, 130 measure the thickness of the can domes 140. The thickness of the can domes 140 is a measure, in a can extruding process, of the quality of the cans being produced. Both the open end laser measuring device 130 and the dome end laser measuring device 128 are very accurate in measuring the distance from each of the laser measuring devices 128, 130 to each side of the dome. These measurements are taken by each of the laser measuring devices 128, 130 and recorded. By subtracting the measured distances and determining variations in the differences, the thickness of the dome or the acceptable amount of variation, can be determined. Calibrated domes or calibrated pieces can be used to calibrate the system so that true measurements can be obtained of the actual thickness of the can dome 140 using the open end laser measuring device 130 and the dome end laser measuring device 128. Of course, these calculations are made in the controller 136. If a can dome 140 is either too thin or too thick, the controller 136 activates the pneumatic can blow-off device 132, which moves the defective can to the can catcher 126. The cans that are not defective are dumped into a can retrieval device 138.

Figure 2:
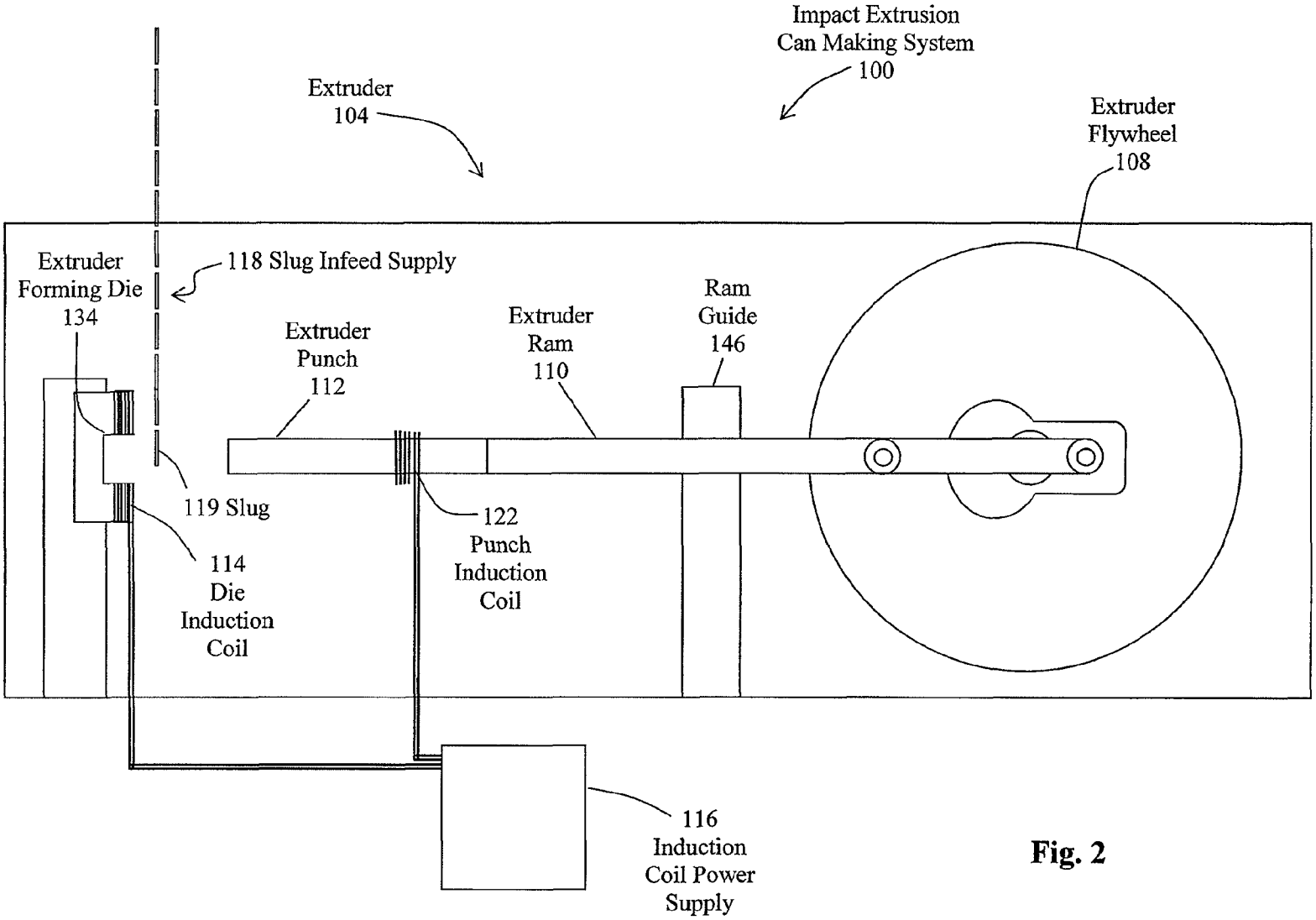
FIG. 2 is a side view of the extruder shown in FIG. 1.

FIG. 2 is a side view of extruder 104 shown in FIG. 1. Extruder 104 comprises extruder fly wheel 108, an extruder ram 110, extruder punch 112, ram guide 146 and a punch induction coil 122. Ram guide 146 controls movement of extruder ram 110. Although an extruder flywheel 108 is illustrated in FIG. 1, any type of ramming device can be used, including a hydraulic ram, or other types of rams, to move the extruder punch 112 with sufficient force and velocity to perform the extrusion process. Extruder flywheel 108 is generically referred to as a punch actuator, and as explained above, the actuator may comprise a hydraulic actuator, or any other mechanical device for driving the extruder ram 110 and extruder punch 112 with sufficient speed and force into the die to extrude the slug 119. Punch induction coil 122 heats extruder punch 112 to an operating temperature for a normally stabilized impact extrusion process, so that little or no start-up time will be required to obtain stabilized operation of the impact extrusion can making system 100. In other words, induction coil power supply 116 supplies a punch induction current 148 to punch induction coil 122 and a die induction current 150 to die induction coil 114, so that extruder forming die 134 and extruder punch 112 are heated to a temperature that is substantially equal to the normal operating temperature for these tools during continuous, stable operation of said impact extrusion process to minimize or eliminate start-up losses in the impact extrusion can making system 100. The wall thickness of the work piece or can is directly correlated to the clearance between the extruder punch 112 and the extruder forming die 134. The controller 136, as explained above, determines the thickness of the can domes 140. The controller 136 may then adjust an adjuster mechanism, which may comprise adjusting either the position of the extruder forming die 134, the location of the extruder punch 112, with respect to extruder forming die 134, or the stroke length of extruder punch 112, in an automatic fashion, so that thicknesses of the can domes 140 fall within a desired range of thicknesses. In that regard, the controller 136 may send a control signal to the extruder adjuster 142 to adjust the stroke or position of the extruder ram 110 and extruder punch 112 in the extruder forming die 134. Alternatively, or in addition to adjusting the extruder 104, the controller can send a control signal to the die adjuster 144 to adjust the position of the extruder forming die 134 with respect to the extruder punch 112. In this manner, the controller 136 can carefully control the thickness of the can domes 140 in an automated fashion. In that regard, the laser measuring devices 128, 130 are capable of providing highly accurately measurements of the thickness of the can domes 140. From these measurements, predictive techniques can be used by the controller 136 for adjustments of the extruder adjuster 142 and/or the die adjuster 144 (collectively referred to as an adjuster) to increase yield and minimize waste. In this manner, human error is eliminated and maximum yield can be achieved using these automated processes.

One of the features of the impact extrusion can making system 100 of FIG. 1 is that the punch induction coil 122 is capable of generating heat in the extruder punch 112 without physical contact between the punch induction coil 122 and the extruder punch 112. The punch induction coil 122 uses electromagnetic induction to heat the extruder punch 112. In accordance with electromagnetic induction, eddy currents are generated within the metal of the extruder punch 112 and the resistance of the metal of the extruder punch 112 leads to joule heating of the metal of the extruder punch 112. The punch induction coil 122 functions as an electromagnet and a radio frequency alternating signal is passed from the induction coil power supply 116 into the punch induction coil 122. Heat is generated by magnetic hysteresis losses in the metal material of the extruder punch 112, which has a predetermined level of permeability sufficient to heat the extruder punch 112. The frequency of the alternating current signal generated by the induction coil power supply 116 is selected based upon the metal type of the extruder punch 112, permeability of the metal, and the size of the extruder punch 112. In a standard can making system, friction is relied upon to create heat in the extrusion process. In other words, the heat created from the impact of the punch on the aluminum slug and friction from the extruder forming die is relied upon to create an optimal can thickness in prior devices. If the machine sits idle, there is no heat being created, and thus a long start up time is required to achieve a desired can thickness, which also creates many improperly formed cans since the cans do not have an optimal thickness.

As indicated above, the induction coil power supply 116 generates an alternating current that is supplied to the punch induction coil 122 and die induction coil 114. Again, an advantage of using induction coils is that no direct contact is required to heat the extruder punch 112 and the extruder forming die 134. Since the extruder punch 112 reciprocally moves, surface contact with a contact heater would be difficult. Rather, the punch induction coil 122 generates electromagnetic waves that are received by the extruder punch 112, which induces currents that heat the extruder punch 112 without contact with the punch induction coil 122. Of course, the same is true with the die induction coil 114. Die induction coil 114 does not necessarily have to be in contact with the extruder forming die 134.

Figure 3:
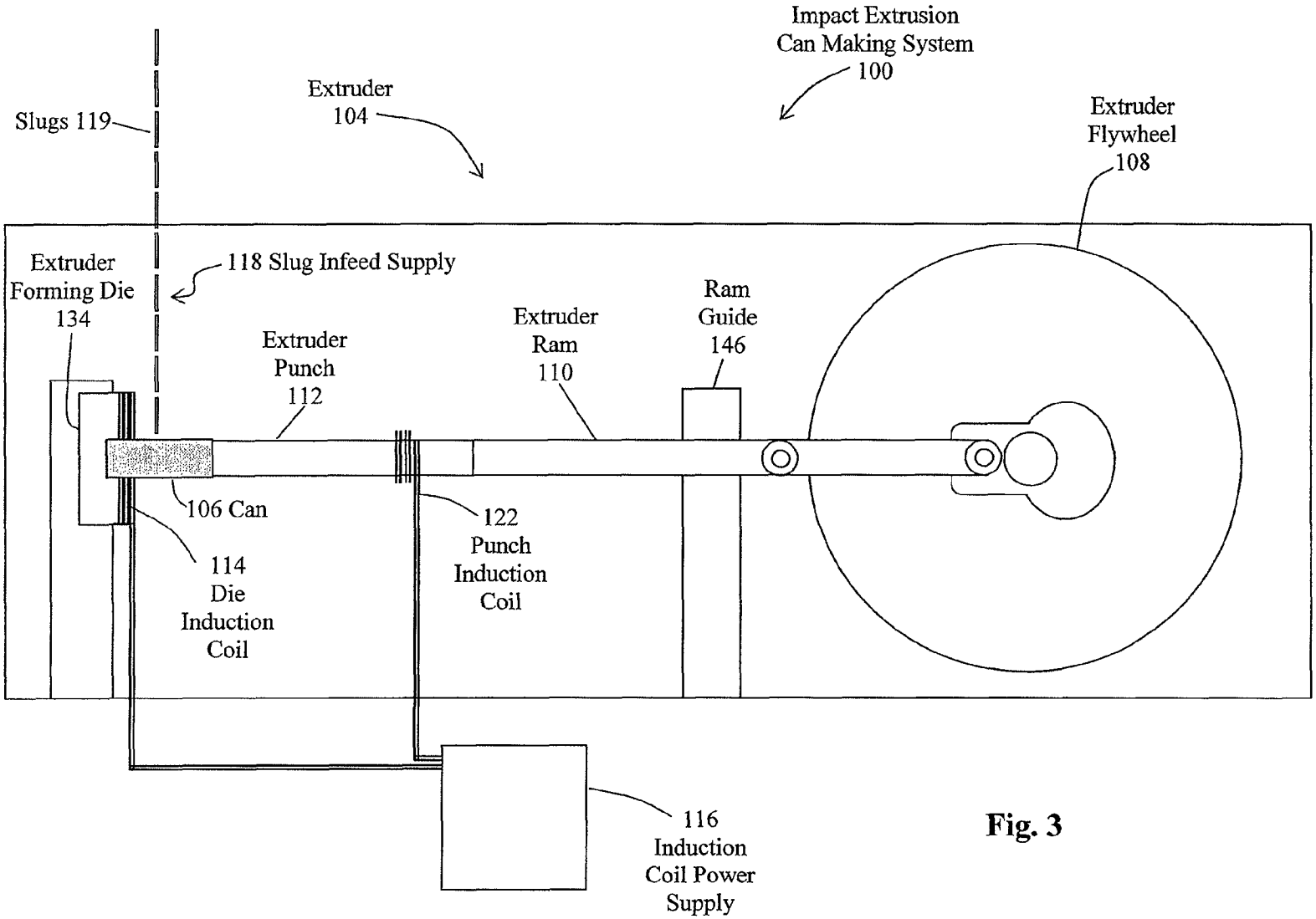
FIG. 3 is a side view of the extruder shown in FIG. 1.

FIG. 3 is a side view of extruder 104 showing extruder punch 112 in an extended position and inserted into extruder forming die 134. Induction coil power supply 116 supplies power to punch induction coil 122 and die induction coil 114 to heat extruder punch 112 and extruder forming die 134. Slug 119 travels down slug in-feed supply 118 and is disposed in alignment with extruder forming die 134. Extruder punch 112 forces slug 119 into the opening in extruder forming die 134. The slug 119 is centered over the opening in extruder forming die 134 and is impact extruded to form cans 106 that are the shape and size of extruder punch 112. Since both the extruder forming die 134 and the extruder punch 112 are heated, and since the extruder punch 112 travels with enough speed, force and distance into the opening of extruder forming die 134, a can having a proper dome thickness, side wall thickness, and height is formed around extruder punch 112.

Figure 4:
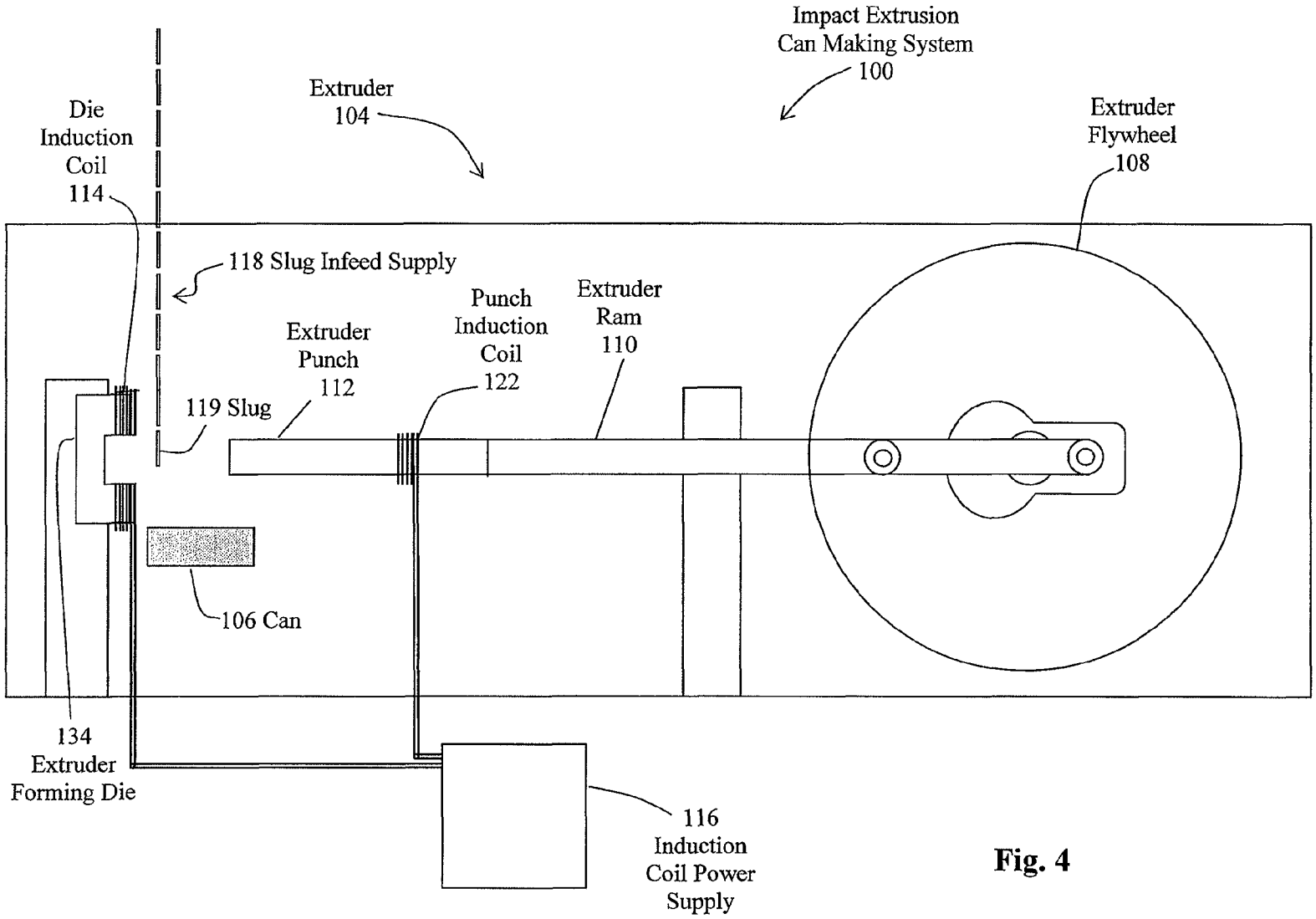
FIG. 4 is a side view of the extruder shown in FIG. 1.

FIG. 4 is a schematic side view of the embodiment of FIG. 3 illustrating the extruder punch 112 in a retracted position with respect to extruder forming die 134. As illustrated in FIG. 4, slug 119 is positioned by the slug in-feed supply 118 to be centered with respect to the opening in the extruder former die 134. When the extruder punch 112 is in the retracted position, the slug in-feed supply 118 moves the slugs so that slug 119 is centered with the opening in the extruder forming die 134. Slug 119 stays in the centered position over the opening in extruder forming die 134 until the extruder flywheel 108 rotates and pushes the extruder ram 110 and the extruder punch 112 toward the extruder forming die 134. The extruder punch 112 then forces the slug 119 into the opening on the extruder forming die 134 with sufficient speed and force to extrude a can, such as can 106. Again, the induction coil power supply 116 generates an AC signal that has a sufficient amount of current and frequency to cause the punch induction coil 122 and the die induction coil 114 to induce currents in extruder punch 112 and extruder forming die 134, which causes the extruder punch 112 and the extruder forming die 134 to be heated to a temperature for continuous, stable operation of the impact extrusion can making system 100. In that regard, the controller 136 (FIG. 1) can be used to either simply turn on and off the induction coil power supply 116, so that the induction coils 122, 114 reach a desired operating temperature (e.g., 250° F.), or the controller 136 can adjust the current levels in the induction coils 122, 114. During the start-up process, friction between the extruder punch 112 and the extruder forming die 134 causes the temperature of extruder punch 112 and extruder forming die 134 to gradually increase. Current is supplied to the induction coils 122, 114 to reduce start-up time. As such, current is applied by the induction coil power supply 116 to induction coils 122, 114. In full operating mode, no current has to be applied to the induction coils 122, 114, since friction supplies sufficient heat.

Figure 5:
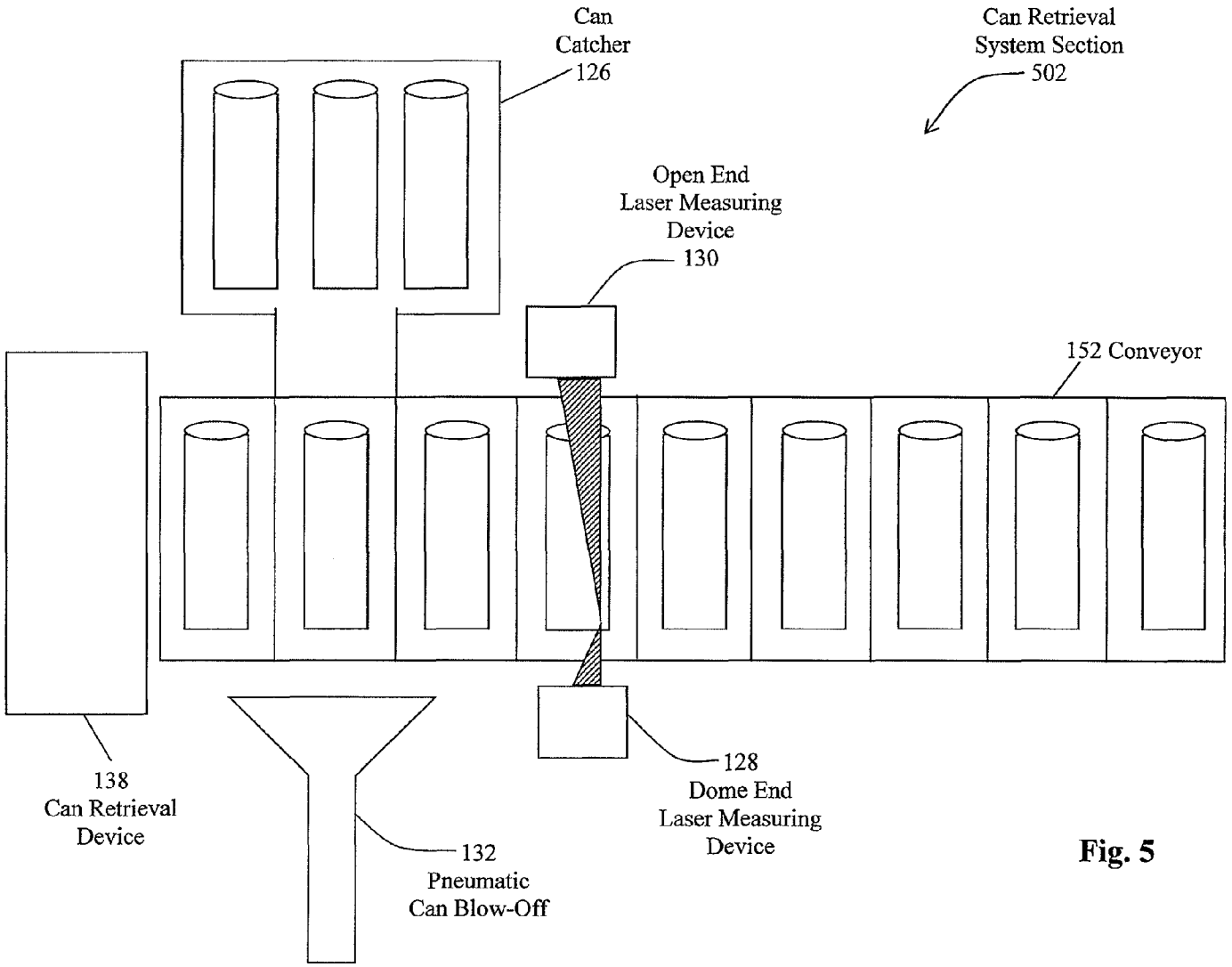
FIG. 5 is a close-up view of the can retrieval section shown in FIG. 1.

FIG. 5 is a close-up view of the can retrieval section 502 of the embodiment of FIG. 1. As illustrated in FIG. 5, the open end laser measuring device 130 determines the distance from the open end laser measuring device 130 to the inside surface of the dome of the can. Similarly, the dome end laser measuring device 128 measures the distance from the dome end laser measuring device 128 to the outside surface of the dome of the can. By subtracting these values, a difference signal is created. The variation of this difference signal from can to can is an indication of the variation of the dome thickness from can to can. A can with a dome that has a desired thickness, or other object that has a calibrated, desired thickness, can be used to calibrate the measuring system by taking the difference value from the laser measuring devices 130, 128 and using the difference value as a target value for dome thicknesses of cans. The amount of variation from a difference target value can be used to set threshold levels for dome thicknesses that are either too thin or too thick. As also illustrated in FIG. 5, pneumatic can blow-off 132 is activated by the controller 136 (FIG. 1)

whenever the difference signal exceeds either of the threshold levels for domes, indicating that the domes are either too thick or too thin. The pneumatic can blow-off device 132 then blows the improperly constructed cans into a can catcher 126. Properly constructed cans continue down the conveyor 152 and pass into a can retrieval device 138.

Figure 6:
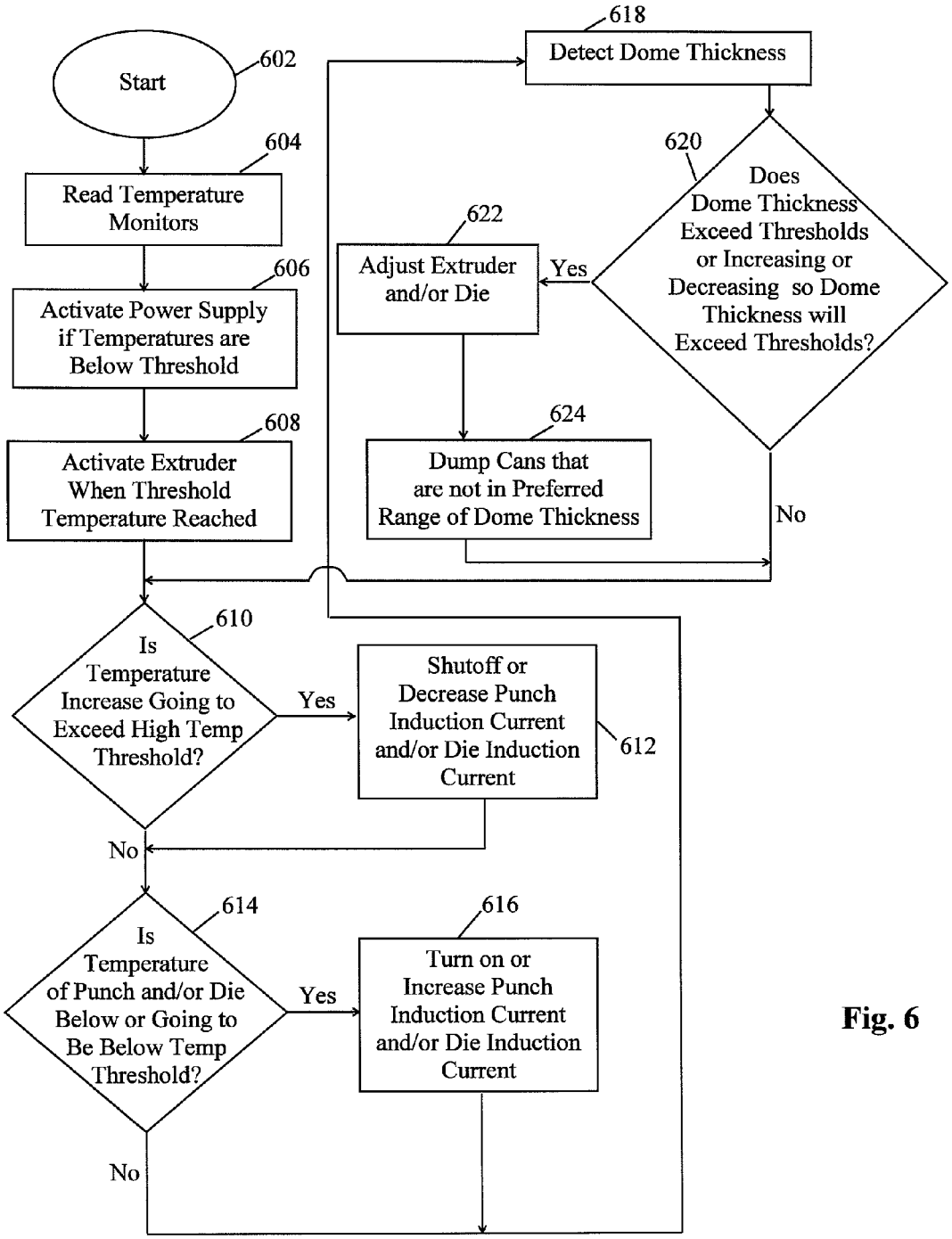
FIG. 6 is an embodiment of a flow diagram for operating the controller.

FIG. 6 is an embodiment of a flow diagram of the operation of the controller 136, illustrated in FIG. 1. The controller 136 may comprise a programmable logic controller, a field programmable gate array, a microprocessor, or other types of gate arrays. The functions illustrated in FIG. 6 may be carried out by either a processor or state machine. As illustrated in FIG. 6, the process starts at step 602. At step 604, the controller 136 reads the temperature monitors, such as temperature monitor 120, which reads the temperature of the extruder punch 112, and temperature monitor 124, which reads the temperature of the extruder forming die 134. At step 606, the induction coil power supply 116 is activated during start-up if the temperatures of either the extruder punch 112, or the extruder forming die 134, are below a predetermined minimum threshold. For example, a threshold of approximately 250° F. may be utilized as a minimum threshold temperature during a start-up phase of the impaction extrusion can making system 100. The induction coil power supply 116 can supply punch induction current 148 to the punch induction coil 122, if the extruder punch 112 is below the threshold temperature. Alternatively, or in addition, induction coil power supply 116 can supply die induction current 150 to die induction coil 114, if the temperature of the extruder forming die 134 is below a predetermined threshold temperature. In other words, the temperature of the extruder punch 112 and the extruder forming die 134 can be independently adjusted.

At step 608 of FIG. 6, the extruder 104 can be activated when the threshold temperatures of the extruder punch 112 and the extruder forming die 134 are reached. The process then proceeds to step 610, where it is determined if the temperature increase of either the extruder punch 112 or the extruder forming die 134 is going to exceed a high temperature threshold. Temperature monitors 120, 124 continuously monitor the temperatures of the extruder punch 112 and the extruder forming die 134, respectively. Controller 136 utilizes a predictive model, which is able to perform predictive analysis to determine if the rate of increase of the temperatures of the extruder punch 112 and the extruder forming die 134 are increasing so fast that the high temperature thresholds will be exceeded. For example, a proportional-integral-derivative controller (PID controller) can be used, which is a controller that is widely used in industrial control systems, that operates using a generic control loop feedback mechanism. A PID controller calculates an error value as the difference between a measured process variable and a desired set point. In this case, the measured process variable is the measured temperature and the desired set point is the desired temperature, e.g., approximately 250° F. The controller attempts to minimize the error by adjusting the process control inputs. The PID controller calculation algorithm involves three separate constant parameters and is sometimes called a three-term control. The PID controller uses the proportional values (P), the integral values (I), and the derivative values (D). These values are interpreted in terms of time. For example, P depends on the present error, I on the accumulation of past errors, and D is a prediction of future errors, based on a current rate of change. The weighted sum of these three actions is used to adjust the process via a control element, such as the current that is applied to the induction coils 122, 114. The PID controller is implemented in the processor that forms part of the controller 136. The controller 136 may either shut off the punch induction coil 122 or the die induction coil 114, or decrease the current supplied to the punch induction coil 122 and/or die induction coil 114, so that the high temperature threshold is not exceeded. Of course, this may occur during a start-up situation in which friction created by the impact extrusion process, plus the heat added by the induction coils 122, 114, may cause the temperature of the extruder punch 112 and extruder forming die 134 to rise rapidly in a manner which causes the temperatures of these devices to exceed the maximum temperature threshold. Accordingly, when the minimum operating temperature threshold is reached, the controller 136 may completely turn off the punch induction current 148 and/or the die induction current 150 to prevent the maximum temperature threshold from being exceeded, as shown at step 612.

As further shown in FIG. 6, the process then proceeds to determine if the temperature of the extruder punch 112 and/or the extruder forming die 134 are below, or going to be below, the low temperature threshold. For example, if the impact extrusion process is slowed down, or if there is a pause in the process, the heat generated by friction by the impact extrusion process may not be sufficient to maintain the extruder punch 112 and extruder forming die 134 at a suitable operating temperature between the low temperature threshold and high temperature threshold. Again, the controller 136 continuously monitors the temperatures of the extruder punch 112 and the extruder forming die 134. Using the predictive analysis techniques that are incorporated in the PID controller of the controller 136, the controller 136 can determine if the extruder punch 112 and/or extruder forming die 134 are going to fall below the minimum threshold temperature and, in response, either turn on or increase the punch induction current 148 or die induction current 150 to maintain at least the minimum temperature threshold, as set forth at steps 616.

The process of FIG. 6 then proceeds to step 618, where the dome thickness is detected. The open end laser measuring device 130 and dome end laser measuring device 128 provide data to the controller 136 indicating the distance of the dome from each of the laser measuring devices 128, 130. These measurements are subtracted to determine a difference measurement. The variation of the difference measurement then provides an indication of the amount of variation in the dome thickness. A calibrated object can be used to determine the actual thickness, so that the difference signal can be tied to actual thicknesses. Threshold levels for the different signals can be established based upon the range of thicknesses that are acceptable for the dome. Because of the high accuracy of the laser measuring devices 128, 130, very accurate measurements can be obtained of the thickness of the dome. In addition, the particular location of the cans 106 on the conveyor 102 is irrelevant to the process of measuring the dome thickness. In this manner, an expensive process of precisely locating the cans 106 on the conveyor 152 is not needed to obtain very precise measurements of the dome thickness using the laser measuring devices 128, 130. At step 620, the controller 136 determines if the dome thickness is less than the minimum thickness or greater than the maximum thickness of the dome. In addition, the dome thickness is continuously measured and the controller 136 can determine if the dome thicknesses of cans 106 is increasing or decreasing. Using predictive analysis techniques of the PID controller utilized by the controller 136, it can be determined whether the increases or decreases in the dome thickness will exceed threshold levels, or if adjustments should be made in advance to control the dome thickness, and the time and amount of these adjustments. If so, the process proceeds to step 622 to adjust the extruder 104 by increasing or decreasing the stroke of the extruder punch 112, or location of the extruder punch 112, using the extruder adjuster 142. In addition, or in place of adjusting the extruder 104, the extruder forming die 134 can be adjusted by the die adjuster 144.

At step 624 of FIG. 6, the controller determines which cans have thicknesses that are outside of the range of dome thicknesses. Controller 136 then activates the pneumatic can blow-off device 132 to blow off cans into can catcher 126 that are not within the preferred range of the dome thickness. The process then returns to step 610, until the impact extrusion can making system 100 is turned off.

The present invention therefore provides a system that uses induction heating that is able to heat the extruder punch 112 and the extruder forming die 134 to a suitable temperature, without touching the extruder punch 112 or the extruder forming die 134, for operating the impact extrusion can making system 100 that is illustrated in FIG. 1. Highly precise laser measuring systems are used to measure dome thickness. These measurements are used by a controller to adjust the stroke and/or position of the extruder punch 112 and/or the extruder forming die 134 in an automated predictive PID control system. High yield and high quality cans can be produced in this fashion. In addition, these techniques can be used on other impact extrusion processes for producing other products with high yield and high quality.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of making a can using an impact extrusion process comprising:

positioning a slug in a substantially centered position over an opening in an extruder forming die;

heating an extruder punch with a punch induction coil using induction heating until said extruder punch reaches first predetermined temperature;

heating said extruder forming die with a die induction coil using induction heating until said extruder forming die reaches a second predetermined temperature;

forcing said slug into said extruder forming die with said extruder punch with sufficient speed and force to extrude said slug into a can after said extruder punch is heated to said first predetermined temperature and after said extruder forming die is heated to said second predetermined temperature;

measuring a thickness of a dome of said can to create a dome thickness signal;

discarding said can if said thickness of said dome is not within a range of thicknesses;

adjusting a clearance between said extruder punch and said extruder forming die in response to said dome thickness signal.

2. The method of claim 1 wherein said first predetermined temperature is a temperature that said extruder punch reaches during continuous and stable operation of said extruder punch as a result of friction created during said impact extrusion process.

3. The method of claim 1 wherein said second predetermined temperature is a temperature that said extruder forming die reaches during continuous and stable operation of said extruder forming die as a result of friction created during said impact extrusion process.

4. The method of claim 1 wherein said process of measuring said thickness of said dome of said can comprises:

measuring a first distance from a first non-contact measuring device to an inside surface of said dome to obtain a first measurement;

measuring a second distance from a second non-contact measuring device to an outside surface of said dome to obtain a second measurement;

subtracting said first measurement and said second measurement to obtain a difference signal;

using said difference signal to determine said thickness of said dome.

5. The method of claim 4 comprising:

measuring a calibration dome;

obtaining a difference signal for said calibration dome;

using variations in said difference signal for said calibration dome to calculate dome thickness.

6. The method of claim 1 wherein said process of adjusting a clearance between said extruder punch and said extruder forming die comprises adjusting said extruder punch.

7. The method of claim 6 wherein said process of adjusting said extruder punch comprises adjusting stroke length of said extruder punch.

8. The method of claim 6 wherein said process of adjusting said extruder punch comprises adjusting a location on said extruder punch.

9. The method of claim 1 wherein said process of adjusting said clearance between said extruder punch and said extruder forming die comprises adjusting a location of said extruder forming die.

10. The method of claim 1 wherein said process of adjusting said clearance between said extruder punch and said extruder forming die is done in response to a control signal from a controller that uses predictive techniques.

11. The method of claim 1 wherein said processes of heating said extruder punch and heating said extruder forming die is done in response to a control signal generated by a controller that monitors temperatures of said extruder punch and said extruder forming die, said control signal using predictive techniques.

12. An impact extrusion apparatus for making a can from a slug comprising:

an extruder forming die having an opening;

an extruder punch that has a size and shape that fits in said opening;

a die induction coil disposed to heat said extruder forming die to a first predetermined temperature using induction heating created by die induction current in said die induction coil;

a punch induction coil disposed to heat said extruder punch to a second predetermined temperature using induction heating created by punch induction current flowing in said punch induction coil;

a punch actuator that drives said extruder punch with sufficient speed and force into said slug and said extruder forming die to extrude said slug into a can after said extruder forming die has been heated to said first predetermined temperature by said die induction coil, and said extruder die has been heated to said second predetermined temperature by said punch induction coil to form said can;

a laser measuring device that measures a thickness of a dome of said can to create a dome thickness signal;

a controller that generates a clearance adjustment control signal in response to said dome thickness signal;

an adjuster that adjusts a clearance space between said extruder forming die and said extruder punch in response to said clearance adjustment control signal to alter said thickness of said dome.

13. The impact extrusion apparatus of claim 12 wherein said adjuster comprises an extruder adjuster.

14. The impact extrusion apparatus of claim 12 wherein said adjuster comprises a die adjuster.

15. The impact extrusion apparatus of claim 12 wherein said adjuster comprises both an extruder adjuster and a die adjuster.

16. The impact extrusion apparatus of claim 12 wherein said controller comprises a controller.

17. The impact extrusion apparatus of claim 12 wherein said controller comprises a microprocessor.

18. The impact extrusion apparatus of claim 12 wherein said controller comprises an FPGA.

19. The impact extrusion apparatus of claim 12 wherein said controller comprises a PID controller.

20. The impact extrusion apparatus of claim 12 wherein said first predetermined temperature is a temperature that said extruder forming die reaches during stable and continuous operation of said impact extrusion apparatus.

21. The impact extrusion apparatus of claim 12 wherein said second predetermined temperature is a temperature that said extruder punch reaches during stable and continuous operation of said impact extrusion apparatus.

22. The impact extrusion apparatus of claim 12 wherein said laser measuring device comprises:

an open end laser measuring device that generates a first measurement signal of a distance between said open end laser measuring device and an inside surface of said dome;

a dome end laser measuring device that generates a second measurement signal that represents a distance between said dome end laser measuring device and an outside surface of said dome;

wherein said controller determines a difference between said first measurement signal and said second measurement signal, which is used to determine said thickness of said dome.

23. The impact extrusion apparatus of claim 12 wherein said controller utilizes predictive techniques to alter said adjuster and said thickness of said dome.

24. The impact extrusion apparatus of claim 12 wherein said controller utilizes predictive techniques to adjust said die induction current and said punch induction current.

25. The impact extrusion apparatus of claim 23 wherein said predictive techniques are generated by a proportional integral-derivative controller.

26. The impact extrusion apparatus of claim 24 wherein said predictive techniques are generated by a proportional integral-derivative controller.

* * * * *